US006241343B1

(12) United States Patent
Shimada et al.

(10) Patent No.: US 6,241,343 B1
(45) Date of Patent: Jun. 5, 2001

(54) DIRECT PRINTING APPARATUS

(75) Inventors: Hirokatsu Shimada, Machida; Toshio Yamaki, Takatsuki; Koji Uno, Kobe; Yoshifumi Shibata; Hiroshi Hiraguchi, both of Toyokawa, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/212,207

(22) Filed: Dec. 16, 1998

(30) Foreign Application Priority Data

Dec. 22, 1997 (JP) ..... 9-352797

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158, 116, 117, 115, 73, 199; 399/271, 290, 293, 294, 295, 184

(56) References Cited

U.S. PATENT DOCUMENTS 5,206,691 4/1993 Mizuno et al. .
5,448,272 9/1995 Kagayama .
5,477,250 12/1995 Larson .
5,495,273 2/1996 Kitamura .

FOREIGN PATENT DOCUMENTS 0 816 944 1/1998 (EP) .
6-297753 10/1994 (JP) .
8-129293 5/1996 (JP) .
WO 95/24675 9/1995 (WO) .

OTHER PUBLICATIONS

Patent Abstracts of Japan, vol. 95, No. 008, Sep. 29, 1995 & JP 07 117258, May 9, 1995 abstract.

*Primary Examiner*—John Barlow
*Assistant Examiner*—Raquel Yvette Gordon
(74) *Attorney, Agent, or Firm*—Morrison & Foerster LLP

(57) ABSTRACT

A direct printing apparatus 2 for depositing printing particles 38 on a print medium 8 comprises a sleeve 30*a* for bearing charged printing particles 38 thereon, a drive roller 30*b* provided in the sleeve 30*a*, the drive roller 30*b* having a smaller outside diameter than an inside diameter of the sleeve 30*a*, a backing electrode 44 opposed to the sleeve 30*a*, a printing head 50 disposed between the sleeve 30*a* and the backing electrode 44, the printing head 50 having a plurality of apertures 56 through which the printing particles 38 can propel and a plurality of electrodes 68 disposed around the plurality of apertures 56. A spacer 90 is provided between the sleeve 30*a* and the printing head 50. The sleeve 30*a* has a slack 31 through which the sleeve 30*a* comes into contact with the spacer 90.

5 Claims, 6 Drawing Sheets

DIRECT PRINTING APPARATUS

This application is based on application No. H9-352797 filed in Japan on Dec. 22, 1997, the content of which is hereby incorporated by reference.

FIELD OF THE INVENTION

The present invention relates to a direct printing apparatus for use in a color copying machine and printer.

BACKGROUND OF THE INVENTION

U.S. Pat. No. 5,477,250 issued on Dec. 19, 1995 discloses a direct printing apparatus. In the direct printing apparatus, four printing stations are disposed along a sheet conveying direction. Each printing station comprises a toner carrier retaining toner on its outer periphery, a backing electrode opposed to the toner carrier and a printing head disposed between the toner carrier and the backing electrode, the printing head having a plurality of apertures and a plurality of electrodes surrounding each aperture. On the outer periphery of the toner carrier in each printing station are retained toner having different colors, for example, magenta, cyan, yellow and black. The backing electrode of each printing station is electrically connected to a power source, thereby between the toner carrier and the backing electrode is formed an electric field for attracting the toner on the toner carrier and propelling it toward the backing electrode through the apertures of the printing head. Between the printing head and the backing electrode in each printing station is formed a passage for a sheet.

When an ON voltage is applied to the electrode of the printing head in the printing station positioned at the most upstream side in the sheet conveying direction, for example, the magenta printing station, the toner attracting force due to the electric field between the toner carrier and the backing electrode propels the toner on the toner carrier through the apertures toward the backing electrode and adheres it to the sheet. When an OFF voltage is applied to the electrode of the printing head, the toner attracting force does not affect the toner on the toner carrier, whereby the toner is never propelled. Thus, when ON and OFF voltage applied to the electrode of the printing head are controlled on the basis of a desired image signal, a magenta image corresponding to the image signal is printed on the sheet. In the same manner, by controlling the ON and OFF voltage applied to the electrode of the printing head in each of the downstream printing stations a different color of image is laid on the previously printed image to form a desired image.

In the aforementioned direct printing apparatus, due to eccentricity or looseness of the toner carrier for retaining toner on its outer periphery, a distance between the toner carrier and the printing head becomes unstable, resulting in unevenness of image density.

SUMMARY OF THE INVENTION

Accordingly, the present invention has been accomplished to solve the aforementioned disadvantages of the prior arts. An object of the present invention is to provide a direct printing apparatus having a constant distance between printing particles bearing member and printing head, enabling to print an image with no unevenness of image density.

In order to achieve the aforementioned object, according to the present invention, there is provided a direct printing apparatus for depositing printing particles on a print medium, comprising:

a sleeve for bearing charged printing particles thereon;

a drive roller provided in the sleeve, the drive roller having a smaller outside diameter than an inside diameter of the sleeve;

a backing electrode opposed to the sleeve;

a power supply connected to the backing electrode for generating an electric field that attract the charged printing particles on the sleeve to propel the same toward said backing electrode;

a printing head disposed between the sleeve and the backing electrode, the printing head having a plurality of apertures through which the printing particles can propel and a plurality of electrodes disposed around the plurality of apertures; and a driver for applying the plurality of electrode with a voltage for allowing the printing particles to be propelled and a voltage for forbidding the printing particles to be propelled in response to an image signal;

wherein a spacer is provided between the sleeve and the printing head and the sleeve has a slack through which the sleeve comes into contact with the spacer.

In the direct printing apparatus of the present invention having such construction as described above, since the slack of the sleeve comes into contact with the spacer positioned between the sleeve and the printing head, the distance between the sleeve and the printing head is held stable even if the drive roller has an eccentricity or looseness.

Preferably, the spacer may be provided with a slit through which the printing particles can pass and which is opposite to the plurality of apertures.

Preferably, the spacer may come into contact with the printing head. In this case, the spacer may comprise at least one wire-like spacer. The direct printing apparatus of the present invention may further comprise a container in which the printing particles are accommodated, wherein the sleeve, the drive roller, and the spacer are provided to the container, and wherein the container is detachable to a body of the printing apparatus.

Preferably, the spacer may be separable from the printing head and the spacer may be such a shape that a portion of the spacer at the side of the printing head comes into approximately point-contact with the printing head. In this case, the spacer may be a wire-like member. The spacer may be provided at only the downstream side of the moving direction of the sleeve with respect to the aperture of the printing head.

BRIEF DESCRIPTION OF THE DRAWINGS

Further objects and advantages of the present invention will be become clear from the following description taken in conjunction with the preferred embodiments thereof with reference to the accompanying drawings, in which.

DETAILED DESCRIPTION OF THE PREFERRED EMBODIMENTS

Figure 1:
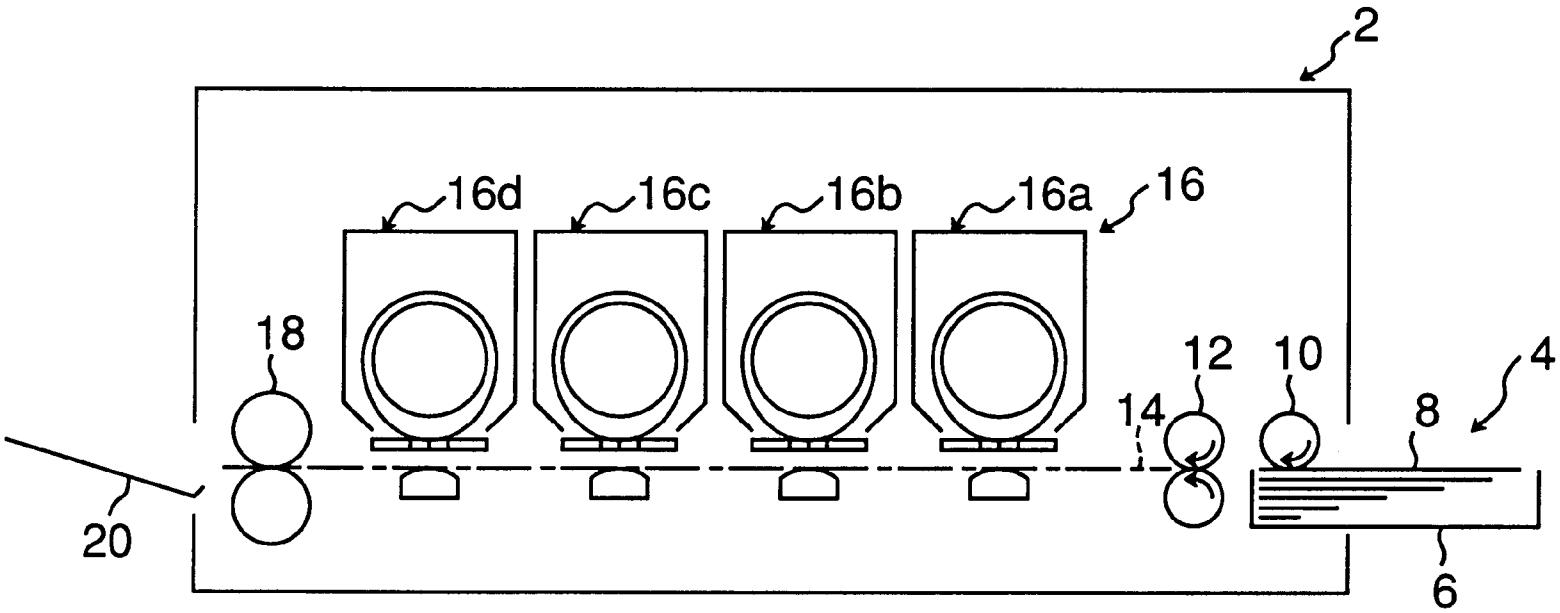
FIG. 1 is a schematic cross-sectional side elevational view of a first embodiment of a tandem type direct printing apparatus of the present invention.

With reference to the drawings and, in particular, to FIG. 1, there is shown a direct printing device, generally indicated by reference numeral 2, according to the present invention. The printing device 2 has a sheet feed station generally indicated by reference numeral 4. The sheet feed station 4 includes a cassette 6 in which a number of sheets 8 or plain papers are stacked. A sheet feed roller 10 is mounted for rotation above the cassette 6 so that it can frictionally contact with the top sheet 8, thereby the feed roller 10 can feed the top sheet 8 into the direct printing device 2 as it rotates. A pair of timing rollers 12 are arranged adjacent to the sheet feed roller 10, for supplying the sheet 8 fed from the cassette 6 through a sheet passage 14 indicated by a dotted line into a printing station, generally indicated by reference numeral 16, where a printing material is deposited on the sheet to form an image thereon. Further, the printing device 2 includes a fusing station 18 for fusing and permanently fixing the image of printing material on the sheet 8, and a final stack station 20 for catching the sheets 8 on which the image has been fixed.

The printing station 16 comprises four printing stations 16*a*, 16*b*, 16*c* and 16*d* equally spaced along the sheet passage 14. These printing stations 16*a*, 16*b*, 16*c* and 16*d* have essentially same construction respectively and therefore one printing station, for example, the printing station 16*a* positioned at the most upstream side in the sheet passage 14 will be explained hereinafter.

Figure 2A:
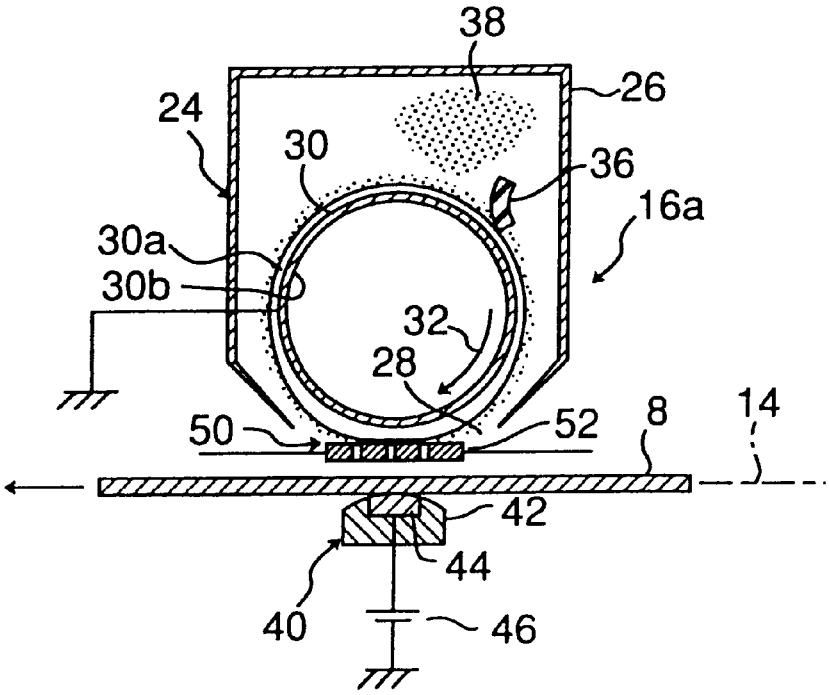
FIG. 2A is a cross-sectional side elevational view of a printing station.
Figure 2B:
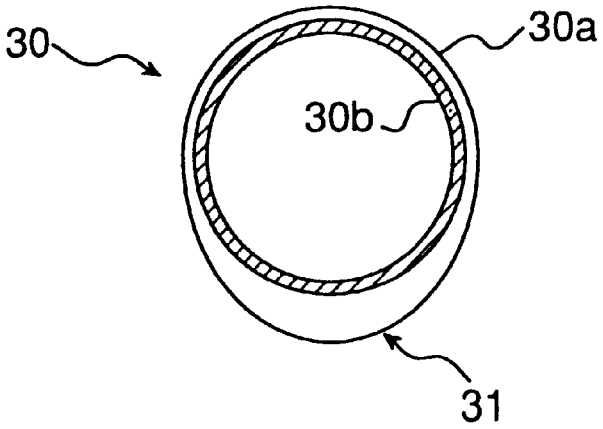
FIG. 2B is a cross-sectional view of a developing roller before installing into the developing device.

Referring to FIG. 2, the printing station 16*a* comprises a developing device generally indicated by reference numeral 24 above the sheet passage 14. The developing device 24 comprises a container 26 which has an opening 28 confronting the sheet passage 14. Adjacent the opening 28, a developing roller 30 is provided. The developing roller 30 comprises a sleeve 30*a* as a bearing member of printing particles according to the present invention and a drive roller 30*b*. The sleeve 30*a* has an endless or cylindrical shape having a thickness of 0.15 mm and a diameter of 20 mm and is made of flexible and conductive material such as nickel, nylon or so. The drive roller 30*b* is contained in the sleeve 30*a* and supported for rotation in a direction indicated by an arrow 32. The outer diameter of the drive roller 30*b* is smaller than the inner diameter of the sleeve 30*a* so that the sleeve 30*a* is formed with a slack 31 as shown in FIG. 2B. The slack 31 comes into contact with a spacer 90 that will be explained hereinafter. The drive roller 30*b* is made of conductive material and is electrically connected to the earth. Alternatively, the sleeve 30*a* can be electrically connected to the earth. A blade 36, preferably made from a plate of elastic material such as rubber or stainless steel, is disposed in contact with the sleeve 30*a*.

The container 26 accommodates printing particles, i.e., toner particles 38. In this embodiment, the toner particles capable of being charged with negative polarity by the contact with the blade 36 are used. The color of the toner particles 38 at each of the printing stations 16*a*, 16*b*, 16*c* and 16*d* is different from each other. For example, the color of the toner particles 38 is magenta at the printing station 16*a*, cyan at the printing station 16*b*, yellow at the printing station 16*c* and black at printing station 16*d*, thereby color printing is possible.

Disposed under the developing device 24, beyond the sheet passage 14, is an electrode mechanism generally indicated by reference numeral 40 which includes a support 42 made of electrically insulative material and a backing electrode 44 made of electrically conductive material. The backing electrode 44 is electrically connected to a direct power supply 46 which supplies a voltage of predetermined polarity (positive polarity in this embodiment) so that the backing electrode 44 is provided with, for example, a voltage of +1200 volts. Thus, between the backing electrode 44 and the developing roller 30 are formed an electric field E that the negatively charged toner particles 38 on the developing roller 30 are electrically attracted to the backing electrode 44.

Figure 3:
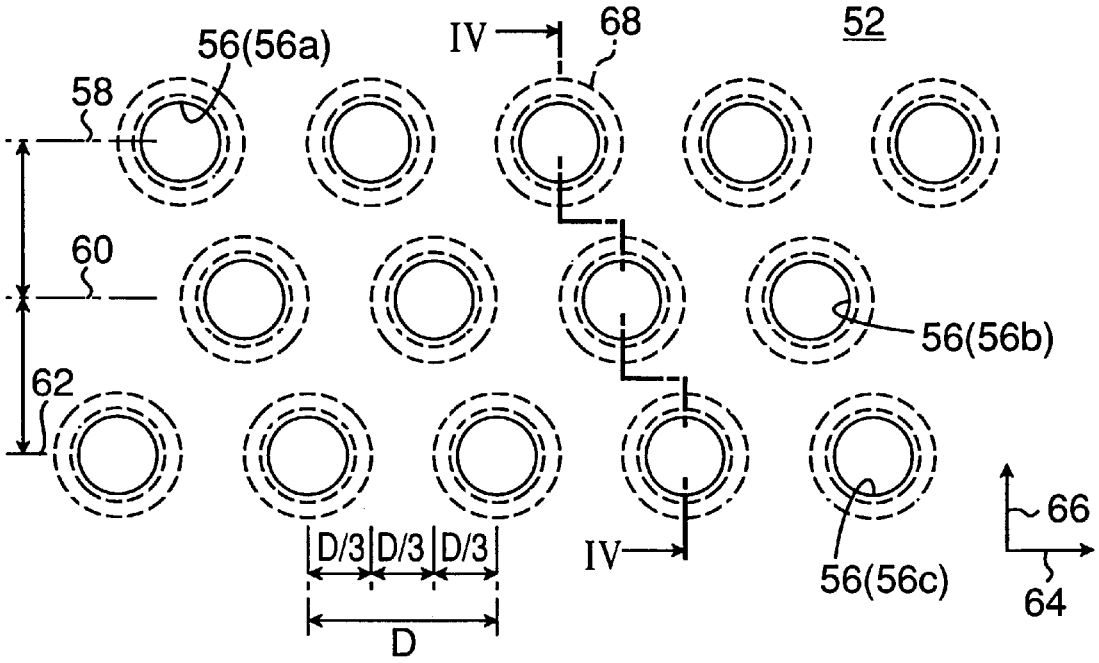
FIG. 3 is an enlarged fragmentary plane view of a printing head.

Fixed between the developing device 24 and the electrode mechanism 40 and above the sheet passage 14 is a printing head generally indicated by reference numeral 50. Preferably, the printing head 50 is made from a flexible printed circuit board 52, having a thickness of about 50 to 150 micrometers. As shown in FIGS. 2 and 3, a portion of the printing head 50 located in a printing zone where the developing roller 30 confronts the backing electrode 44 includes a plurality of apertures 56 having a diameter of about 25 to 200 micrometers which is substantially larger than an average diameter (about several micrometers to a dozen micrometers) of the toner particles 38.

In this embodiment, as best shown in FIG. 3, the apertures 56 are formed on equally spaced three parallel lines 58, 60 and 62 each extending in a direction indicated by reference numeral 64 which is parallel to an axis of the developing roller 30 and perpendicular to a direction indicated by reference numeral 66 along which the sheet 8 will be transported, ensuring the printing head 50 with a resolution of 600 dpi. The apertures 56 on the lines 58, 60 and 62 are formed at regular intervals of D, e.g., 127 micrometers, and the apertures 56(56*a*) and 56(56*c*) on the lines 58 and 62 are shifted by the distance D/N to the opposite directions with respect the apertures 56(56*b*) on the central line 60, respectively, so that, when viewed from the sheet transporting direction 66, the apertures 56 appear to be equally spaced. Note that the number N represents the number of line rows and is "3" in this embodiment, however, the number N as well as the interval D can be determined depending upon the required resolution of the print head.

The flexible printed circuit board 52 further includes therein doughnut-like first and second electrodes 68 and 70 each of which surrounding the apertures 56. The first electrode 68 is disposed on one side opposing the developing roller 30 while the second electrode 70 is on the other side opposing the backing electrode 44.

The first electrode 68 is electrically communicated with a driver 72 through a printed wire 74 and the second electrode 70 is electrically communicated with a driver 76 through a printed wire 78, so that the drivers 72 and 76 can transmit image signals to the first and second electrodes 68 and 70, respectively. The drivers 72 and 76 are in turn electrically communicated with a controller 80 that feeds out data of image to be reproduced by the printing device 2.

The image signals to be transmitted to the first and second electrodes 68 and 70 consist of a DC component constantly applied to the first and second electrodes 68, 70 and a pulse component applied to the first and second electrodes 68, 70 in response to the image data from the controller 80 for forming dots on the sheet 8.

In the concrete, in this embodiment, for the first electrode 68, the base voltage V1(B) is about −50 volts, and the pulse voltage V1(P) is about +300 volts. For the second electrode 70, the base voltage V2(B) is about −100 volts and the pulse voltage V2(P) is about +200 volts.

Figure 4:
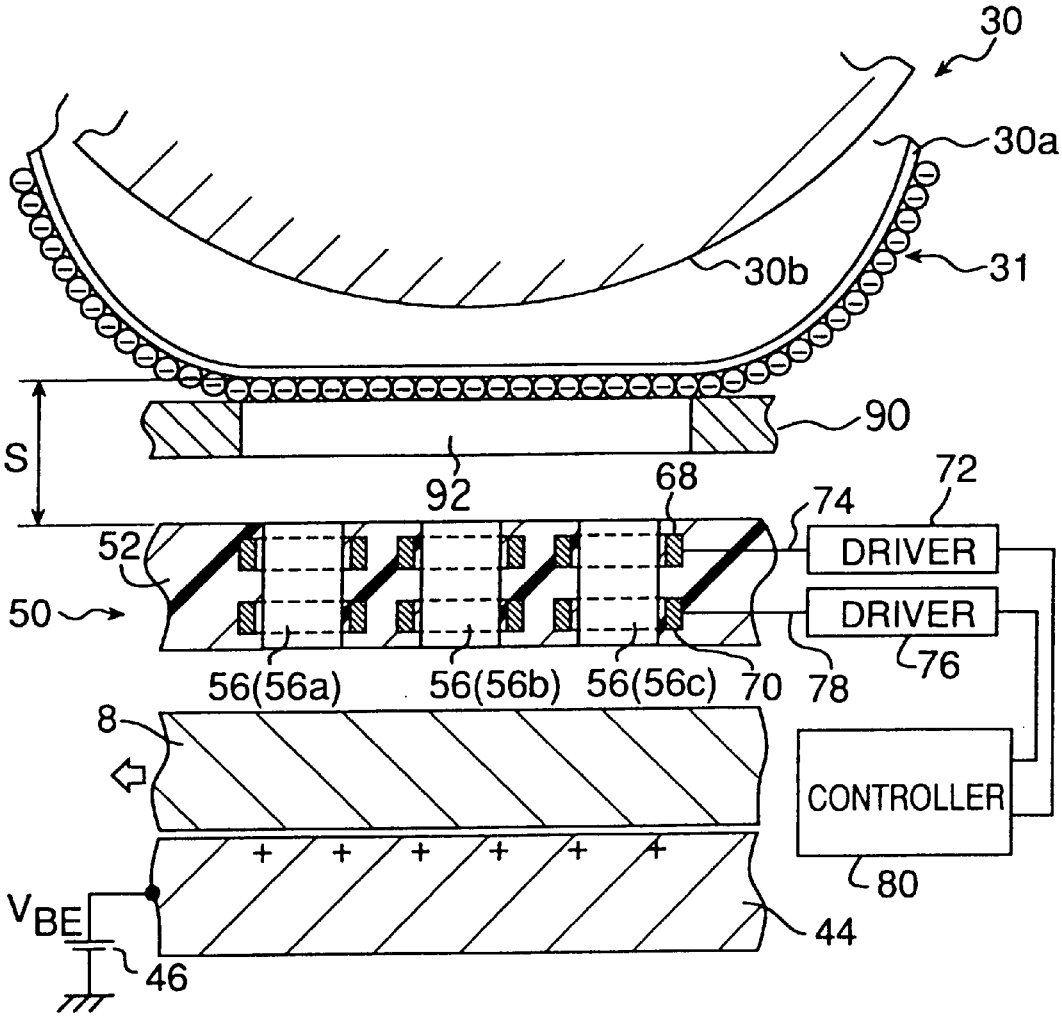
FIG. 4 is an enlarged fragmentary cross-sectional view of the printing head, developing roller and backing electrode taken along a line IV—IV in FIG. 3.

Between the developing roller 30 and the printing head 50 is disposed a spacer 90. The spacer 90 has a plate-like shape and is made of stainless, PET, PEN or the like. As shown in FIG. 4, at a position opposing to the portion in which the apertures 56 of the printing head 50 is formed, the spacer 90 is formed with a slit 92 extending to the main scanning direction (perpendicular to the surface of the drawing). The slack 31 of the sleeve 30*a* of the developing roller 30 comes into contact with the spacer 90 so that the slack 31 is opposed to the slit 92 in a flat condition. Thus, the distance S between the sleeve 30*a* and the printing head 50 is held stable even if the drive roller 30*b* has an eccentricity or looseness.

As a spacer 90, mesh, membrane sheet (film), metal rod and so on can be used. The Rod type spacer may be rotatably provided so that the friction between the spacer and the sleeve can be reduced.

Having described the construction of the printing device 2, its operation will now be described.

As shown in FIG. 2, in the first printing station 16*a*, the drive roller 30*b* of the developing roller 30 rotates in the direction indicated by the arrow 32, allowing the sleeve 30*a* to rotate in the same direction. The toner particles 38 are deposited on the sleeve 30*a* and then transported into a contact region of the blade 36 and the sleeve 30*a* where the toner particles 38 are provided with triboelectric negative charge by the frictional contact of the blade 36. Thereby, as shown in FIG. 4, incremental peripheral portions of the developing roller 30 which has passed through the contact region bear a thin layer of charged toner particles 38.

The slack 31 of the sleeve 30*a* of the developing roller 30 comes into contact with the spacer 90, whereby the slack 31 is opposed to the slit 92 in a flat condition. Thus, the distance S between the sleeve 30*a* and the printing head 50 is held stable even if the drive roller 30*b* has an eccentricity or looseness.

In the printing head 50, the first and second electrodes 68 and 70 are constantly biased to the base voltage V1(B) of about −50 volts and V2(B) of about −100 volts. Therefore, the negatively charge toner particle 38 on the sleeve 30*a* of the developing roller 30 electrically repels against the first and second electrodes 68 and 70 and therefore stays on the sleeve 30*a* without propelling toward the aperture 56.

The controller 80 outputs the image data corresponding to a magenta image to be reproduced to the drivers 72 and 76. In response to the image data, the drivers 72 and 76 supplies the respective voltages V1(P) of about +300 volts and V2(P) of about +200 volts to the pairs of first and second electrodes 68 and 70. As a result, the toner particles 38 on the portions of the sleeve 30*a* confronting the biased electrodes are electrically attracted by the first and second electrodes 68 and 70. This energizes a number of toner particles 38 to propel by the attraction force of the backing electrode 44 into the opposing aperture 56.

When the toner particles 38 have reached respective positions adjacent to the first and second electrodes 68 and 70, the voltages to be applied to the first and second electrodes 68 and 70 are changed from the pulse voltages V1(P) and V2(P) to base voltages V1(B) and V2(B), at respective timings. As a result, the toner particles 38 in the aperture 56 are then forced radially inwardly by the repelling force from the first and second electrodes 68 and 70 applied with the base voltages V1(B) and V2(B), respectively, and then converged into a mass. The converged mass of the toner particles 38 are then deposited on the sheet 8 which is moving past the printing zone 54, thereby forming a layer of the magenta toner particles on the sheet 8. The aforementioned second electrode 70 is provided mainly for the purpose of converging the mass of the toner particles 38. Therefore, the second electrode 70 can be excluded if necessary. The second electrode 70 may be a shape divided from the doughnut-like shape to control the flying direction of the mass of the toner particles 38.

In the same manner, in the second printing station 16*b*, a layer of cyan toner particles is formed over the layer of magenta toner particles formed by the first printing station 16*a*. Then, in the third printing station 16*c*, a layer of yellow toner particles is formed over the layer of cyan toner particles formed by the second printing station 16*b*. Finally, in the fourth printing station 16*d*, a layer of black toner particles is formed over the layer of yellow toner particles formed by the third printing station 16*c*. Thus, a desired color image is formed on the sheet 8.

Subsequently, the sheet 8 to which the image consists of the layers of the toner particles 38 is formed is transported in the fusing station 18 where the layers of the toner particles 38 are fused and permanently fixed on the sheet 8 and finally fed out onto the final stack station or catch tray 20.

In the aforementioned embodiment, the printing head is often used over a machine life of the direct printing apparatus 2. Therefore, if the spacer 90 is integrally adhered to the printing head 50, the using time of the spacer 90 will become extremely longer. Actually, there is few material for the spacer that does not cause problems such as adhesion of the toner particles to the spacer, scraping of the spacer by the toner particles and so on in spite of contact with the sleeve 30*a* and toner 38 over the machine life. Therefore, it is preferable that the spacer 90 in the aforementioned embodiment can be separated from the printing head 50 and can be replaced along with the developing device 24. That is, it is preferable that the spacer 90 is adhered to the container 26 and that the container 26 is detachably provided to the printing device 2. The separable spacer 90 eliminates the necessity of matching its life span to that of the printing head 50 and the use of special material, enabling the apparatus to be constructed flexibly. However, in the construction that the spacer 90 can be replaced along with the developing device 24, upon fitting the spacer 90 the toner particles 38 enter into a gap between the spacer 90 and the printing head 50, which loosing the essential function of holding the distance S between the sleeve 30*a* and the printing head 50 stable.

Figure 5:
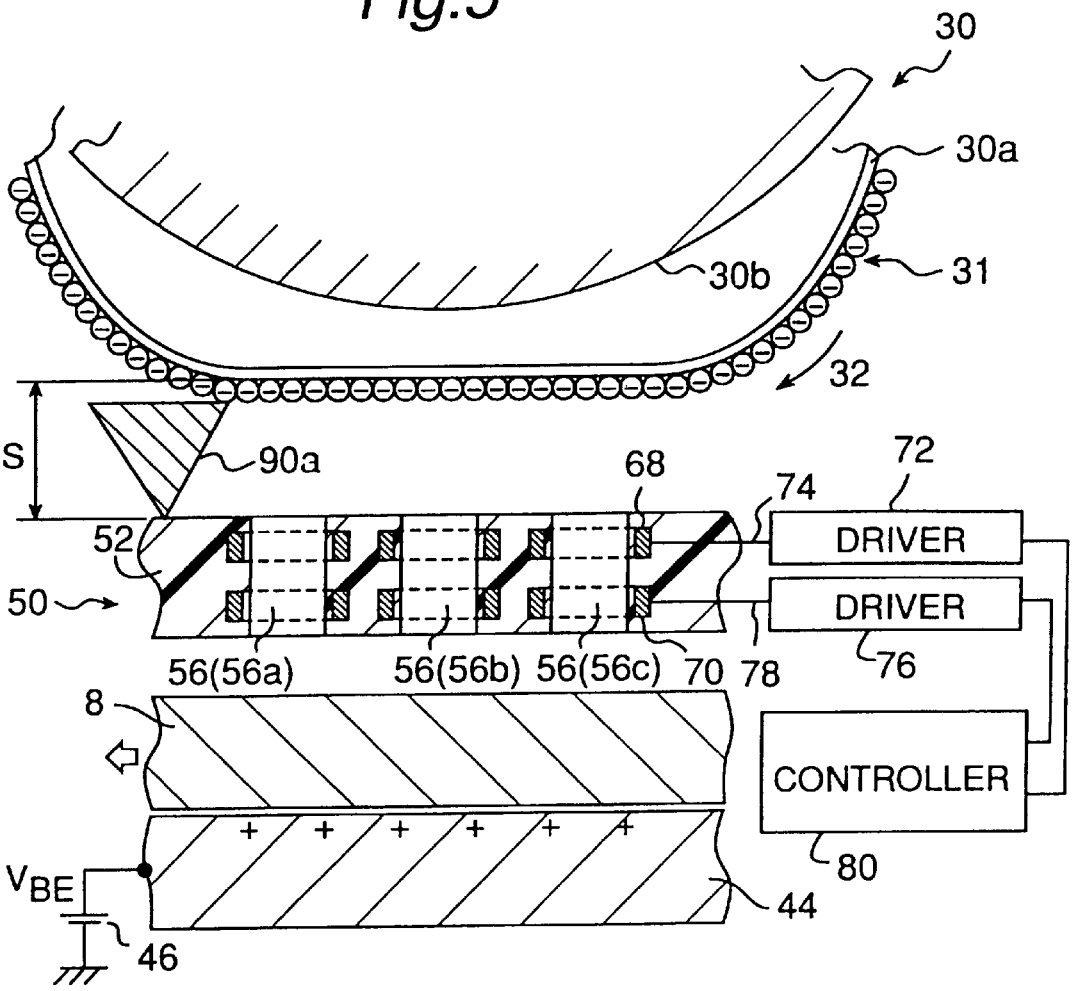
FIG. 5 is an enlarged fragmentary cross-sectional view of the printing station having a wire-like spacer.
Figure 6A:
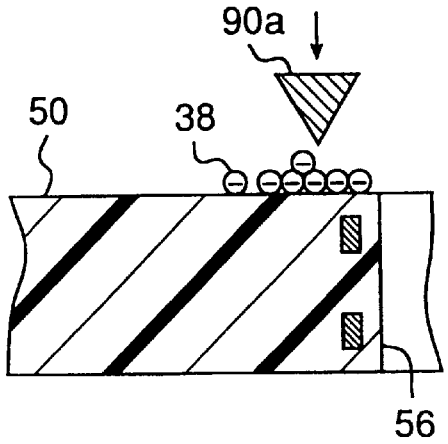
FIGS. 6A and 6B is a cross-sectional view showing a condition that the toner particles adhered to the printing head is pushed out by the wire-like spacer.
Figure 6B:
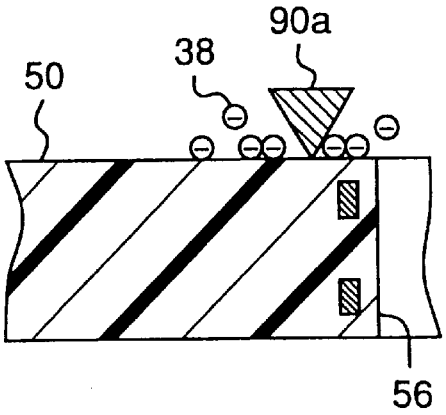

So, as shown in FIG. 5, the spacer 90*a* separable from the printing head 50 is preferably a wire-like member of made of a material having high abrasion resistance such as a metal material, a ceramic material, a carbon fiber material, an organic material, and so on, the cross-sectional shape of which is such a shape that a portion of the spacer 90*a* at the side of the printing head 50 comes into approximately point-contact with the printing head 50. As shown in FIGS. 6A and 6B, upon fitting the spacer 90*a*, the toner particles 38 adhered to the printing head 50 can be push out by the spacer 90*a*. Thus, it can be minimized that the toner particles 38 or the like enter into the gap between the spacer 90*a* and the printing head 50, eliminating the unstableness of the distance between the sleeve 30*a* and the printing head 50.

Figure 7:
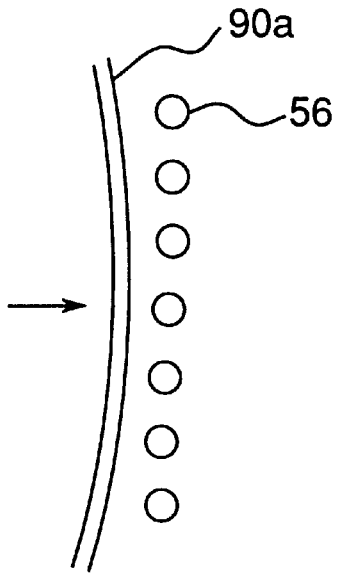
FIG. 7 is a plane view of the wire-like spacer extending in the main scanning direction and the printing head.

In the aforementioned embodiment as shown in FIG. 5, the toner particles 38 adhered to the spacer 90*a* and the printing head 50 can be easily cleaned by vibrating the wire-like spacer 90*a*. The wire-like spacer 90*a* is preferably disposed so as to extend in the main scanning direction. In this case, the wire-like spacer 90*a* is dragged by the rotation of the sleeve 30*a*, causing the central portion thereof to be bent as shown in FIG. 7. This is advantageous because the distance S between the sleeve 30*a* and the printing head 50 at the central portion tends to become smaller than that at the both ends.

The spacer 90*a*, as shown in FIG. 5, is preferably provided at only the downstream side of the moving direction of the sleeve 30*a* with respect to the aperture 56 of the printing head 50. This prevents a phenomenon that the toner particles 38 on the sleeve 30*a* is disturbed due to the contact with the spacer 90*a* before being used to print and enables to print an image with no unevenness of image density.

Figure 8A:
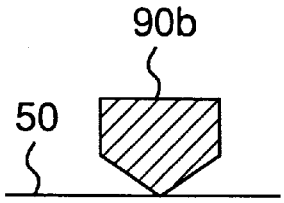
FIGS. 8A, 8B and 8C are cross-sectional views of the spacer having other cross-sectional shapes.
Figure 8B:
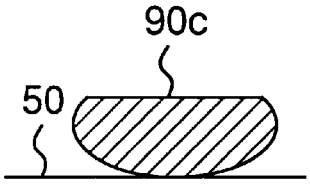
Figure 8C:
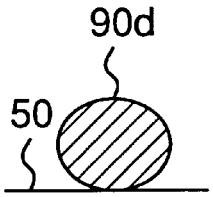

The cross-sectional shape of the wire-like spacer 90*a* is not limited to the acute-angle triangle. As shown in FIGS. 8A, 8B and 8C, obtuse-angle triangle (90*b*), ellipse (90*c*), circular (90*d*) and so on can be used.

Although the direct printing apparatus 2 in the aforementioned embodiment is a tandem type, the present invention is also applicable to a monochrome type of direct printing apparatus having a single developing device.

Furthermore, as a sheet conveying apparatus, an endless belt type of conveying belt or a cylindrical type of conveying drum can be provided.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A direct printing apparatus for depositing printing particles on a print medium, comprising:

a sleeve for bearing charged printing particles thereon;

a drive roller provided in the sleeve, the drive roller having a smaller outside diameter than an inside diameter of the sleeve;

a backing electrode opposed to the sleeve;

a power supply connected to the backing electrode for generating an electric field that attract the charged printing particles on the sleeve to propel the same toward said backing electrode;

a printing head disposed between the sleeve and the backing electrode, the printing head having a plurality of apertures through which the printing particles can propel and a plurality of electrodes disposed around the plurality of apertures; and a driver for applying the plurality of electrode with a voltage for allowing the printing particles to be propelled and a voltage for forbidding the printing particles to be propelled in response to an image signal;

wherein a spacer is provided between the sleeve and the printing head and the sleeve has a slack through which the sleeve comes into contact with the spacer.

2. A direct printing apparatus as claimed in claim 1, wherein the spacer is provided with a slit through which the printing particles can pass and which is opposite to the plurality of apertures.

3. A direct printing apparatus as claimed in claim 1, wherein the spacer comes into contact with the printing head.

4. A direct printing apparatus as claimed in claim 3, wherein the spacer comprises at least one wire-like spacer.

5. A direct printing apparatus as claimed in claim 1, further comprising a container in which the printing particles are accommodated, wherein the sleeve, the drive roller, and the spacer are provided to the container, and wherein the container is detachable to a body of the printing apparatus.

* * * * *

UNITED STATES PATENT AND TRADEMARK OFFICE

CERTIFICATE OF CORRECTION

PATENT NO. : 6,241,343 B1
DATED : June 5, 2001
INVENTOR(S) : Hirokatsu Shimada et al.

It is certified that error appears in the above-identified patent and that said Letters Patent is hereby corrected as shown below:

Title page:
In [73] Assignee: add -- Array Printers AB, Vastra Frolunda, Sweden. --

Signed and Sealed this

Twenty fifth Day of September, 2001

*Attest:*

Nicholas P. Godici

NICHOLAS P. GODICI
*Acting Director of the United States Patent and Trademark Office*

*Attesting Officer*